US005490495A

United States Patent [19]

Smoker et al.

[11] Patent Number: 5,490,495

[45] Date of Patent: Feb. 13, 1996

[54] CLEANOUT HEADER FOR MULTI OIL FURNACES

[75] Inventors: Beneul F. Smoker; David J. Yoder; Benjamin K. Smoker; Frederick W. Phillips, all of Leola; Emanuel S. Beiler, Gordonville, all of Pa.

[73] Assignee: Clean Burn, Inc., Leola, Pa.

[21] Appl. No.: 227,334

[22] Filed: Apr. 14, 1994

[51] Int. Cl.[6] ..... F24H 3/06

[52] U.S. Cl. ..... 126/104 R; 126/76; 126/110 A; 126/116 R; 126/109; 126/390

[58] Field of Search ..... 126/104, 76, 110 A, 126/144, 116, 109, 390

[56] References Cited

U.S. PATENT DOCUMENTS

| | | | |
|---|---|---|---|
| 1,137,765 | 4/1915 | Speer | 126/104 |
| 1,334,741 | 3/1920 | Dundon | 126/104 |
| 1,462,339 | 12/1920 | Harrison | 126/104 |
| 3,106,200 | 10/1963 | Muckelrath | 126/109 |
| 3,712,286 | 1/1973 | Nelson | 126/104 |
| 4,029,145 | 6/1977 | Pfouts | 165/161 |
| 4,147,209 | 4/1979 | Persson | 165/161 |
| 4,162,887 | 7/1979 | Gray | 431/28 |
| 4,479,481 | 10/1984 | Ingersol | 126/76 |
| 5,022,379 | 6/1991 | Wilson | 126/116 |

OTHER PUBLICATIONS

Jun. 1990, Reznor sales brochure for "Waste Oil Heater".

Aug. 25, 1992, Clean Burn Operator's Manual for Models CB–90–AH and CB–90–BH With CB–90–HS Burner.

*Primary Examiner*—Larry Jones

*Attorney, Agent, or Firm*—Larry W. Miller

[57] ABSTRACT

A multi oil furnace is disclosed wherein the front door is sealable against the burner chamber and against a lip extending around the circumference of a front header formed in the cabinet shell to operatively interconnect an upper bank of heat exchanger conduits with a lower bank of heat exchanger conduits. The exhaust gases flow from the burner chamber into the upper bank of conduits to the front header where the exhaust gases must flow around the burner chamber to the lower bank of heat exchanger conduits. The lip extending around the periphery of the front header is recessed below the lower bank of conduits to permit an accumulation of ash precipitated from the exhaust gases. The front door carries longitudinally offset sealing surfaces to seal against both the burner chamber and the header lip. Both the upper and lower banks of conduits, the burner chamber and the front header are accessible through the opening corresponding to the front door when moved to its opened position.

21 Claims, 5 Drawing Sheets

CLEANOUT HEADER FOR MULTI OIL FURNACES

BACKGROUND OF THE INVENTION

This invention relates generally to furnaces for the burning of used oil and, more particularly, to the construction of the furnace to direct the flow of the exhaust gasses generated from the combustion of fuel within the furnace to enhance the efficiency of the operation of the furnace to heat an ambient medium such as ventilation air.

Multi oil furnaces are similar to standard oil burning furnaces, but have been adapted to handle oil products that have been previously used in a traditional lubricating operation, such as used crankcase oil up to 50 SAE, used transmission fluid, and even #2, #4 and #5 fuel oils. Such oil products can have significantly varying viscosities and significantly varying burning characteristics, as well. Typically, used oil products are collected into a tank to be supplied to the furnace from a single source. As furnaces are normally operated when the ambient air temperatures are sufficiently cold to warrant the use of the furnace, the supply of used oil to the furnace is normally as cold as the ambient temperature, which requires a preheating of the used oil to more efficiently effect a burning of the used oil products.

The burner nozzle combines a flow of compressed air with the flow of preheated used oil to atomize the used oil and inject a stream of compressed air and atomized used oil droplets into the burner chamber of the multi oil furnace where it is ignited to create a flame and provide a heat source. Known multi oil furnace burner nozzles utilize an in-line burner nozzle configuration coupled directly to the front door of the multi oil furnace.

The construction of the furnace is important in the efficiency of its operation. A burner chamber with a flame target at the end opposite the burner nozzle is provided to contain the flame and provide an exit for the combustion gases (or flue gases) past the target. Known furnace configurations, such as the Clean Burn Model CB-90 multi oil furnaces, redirect the combustion gases through a serpentine path to the side of the burner chamber utilizing conduits before discharging the gases from the furnace so that ventilation air can be forced around the conduits to absorb heat therefrom.

SUMMARY OF THE INVENTION

It is an object of this invention to improve the efficiency of the operation of a multi oil furnaces by incorporating into the furnace construction an improved flow path for the combustion gases.

It is another object of this invention to provide a multi oil furnace in which the combustion gases are direct from the rear of the burner chamber over top of the burner chamber and then underneath the burner chamber before being discharged from the furnace.

It is a feature of this invention that a ventilation chamber can be provided centrally within the furnace configuration.

It is another feature of this invention that the exhaust path flow path is formed by an upper bank of spaced apart conduits positioned above the burner chamber and by a lower bank of spaced apart conduits positioned below the burner chamber.

It is another advantage of this invention that the central ventilation chamber will allow the flow of an ambient medium around the burner chamber and the respective conduits to efficiently absorb heat therefrom before the combustion gases are discharged from the furnace.

It is still another feature of this invention that the changes in direction of combustion gas flow are accomplished by headers.

It is still another advantage of this invention that the combustion gas flow path is required to undertake abrupt right angle turns as the combustion gas cools to precipitate any ash or debris from the flow of the combustion gases before being discharged from the furnace.

It is still another feature of this invention that the each header downstream of the burner chamber is provided with a cleanout to allow precipitated ash and debris to be cleaned from the furnace periodically.

It is yet another advantage of this invention that the combustion gases are completely isolated from the flow of an ambient ventilation medium through the furnace.

It is a yet another feature of this invention that the outlet header coupling the lower bank of conduits and the discharge opening is provided with a pair of opposing lateral openings to allow a selected one of the openings to be used to discharge combustion gases from the furnace and the remaining opening to be utilized as a cleanout access opening.

It is yet another object of this invention to improve the serviceability of a multi oil furnace.

It is yet another feature of this invention that the heat exchanger conduits and the front header are easily accessible through the opened front door to facilitate cleaning.

It is a further advantage of this invention that substantially the entire heat exchanger can be cleaned through an opened front furnace door without further disassembly of the furnace.

It is a further object of this invention to locate the lip defining the periphery of the front header sufficiently below the lower bank of heat exchanger conduits to permit the accumulation of ash precipitated from the flow of exhaust gases through the front header.

It is a further object of this invention to provide a multi oil furnace which is durable in construction, inexpensive of manufacture, carefree of maintenance, facile in assemblage, and simple and effective in use.

These and other objects, features, and advantages are accomplished according to the instant invention by providing a multi oil furnace wherein the front door of the furnace is sealable against the burner chamber and against a lip extending around the circumference of a front header formed in the cabinet shell to operatively interconnect an upper bank of heat exchanger conduits with a lower bank of heat exchanger conduits. The exhaust gases flow from the burner chamber into the upper bank of conduits to the front header where the exhaust gases must flow around the burner chamber to the lower bank of heat exchanger conduits. The lip extending around the periphery of the front header is recessed below the lower bank of conduits to permit an accumulation of ash precipitated from the exhaust gases. The front door carries longitudinally offset sealing surfaces to seal against both the burner chamber and the header lip. Both the upper and lower banks of conduits, the burner chamber and the front header are accessible through the opening corresponding to the front door when moved to its opened position.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
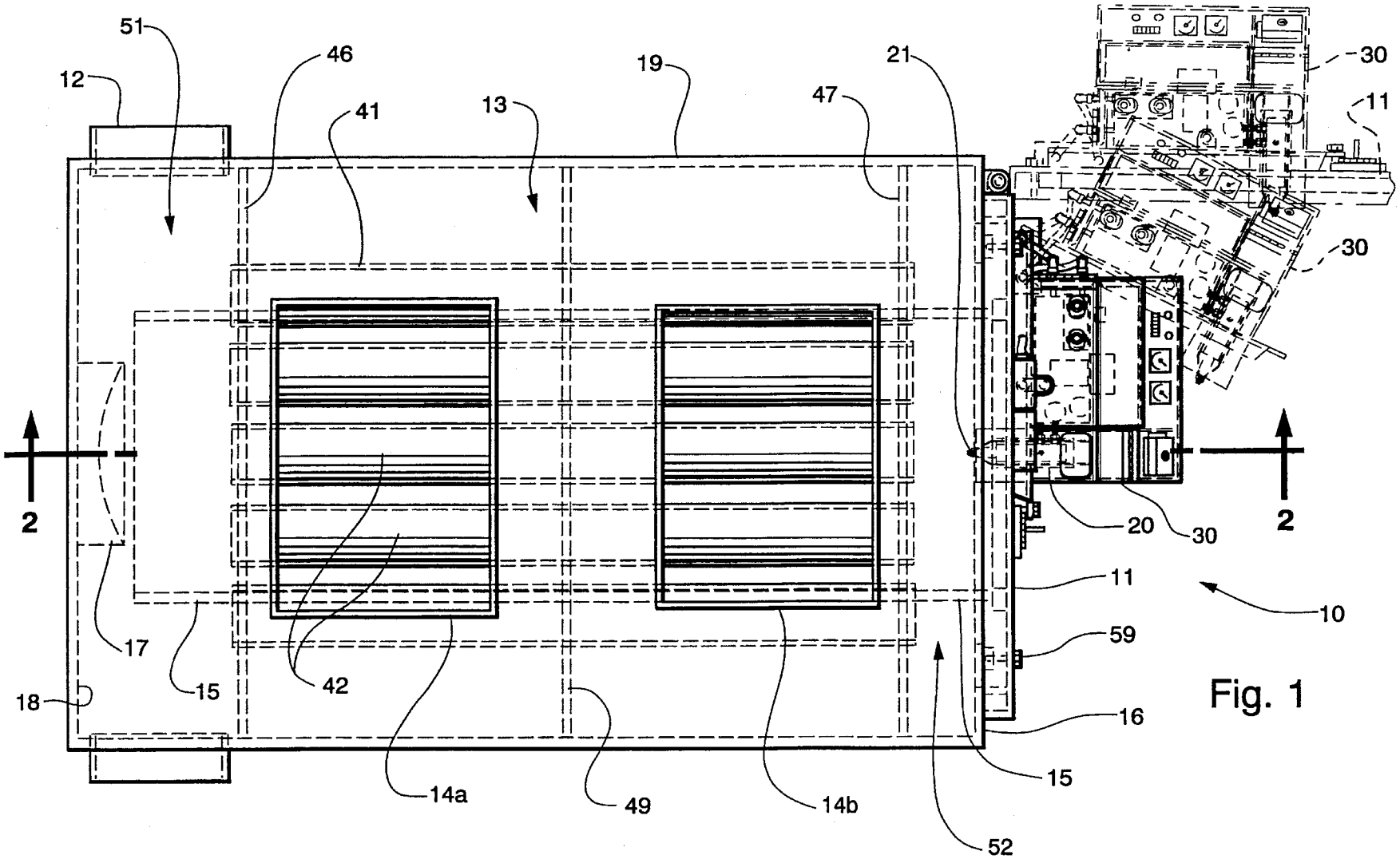
FIG. 1 is a top plan view of a multi oil furnace incorporating the principles of the instant invention, the pivotal movements of the burner housing both moving independently of the front door of the furnace cabinet and moving with the pivotal movement of the front door being shown in phantom.
Figure 2:
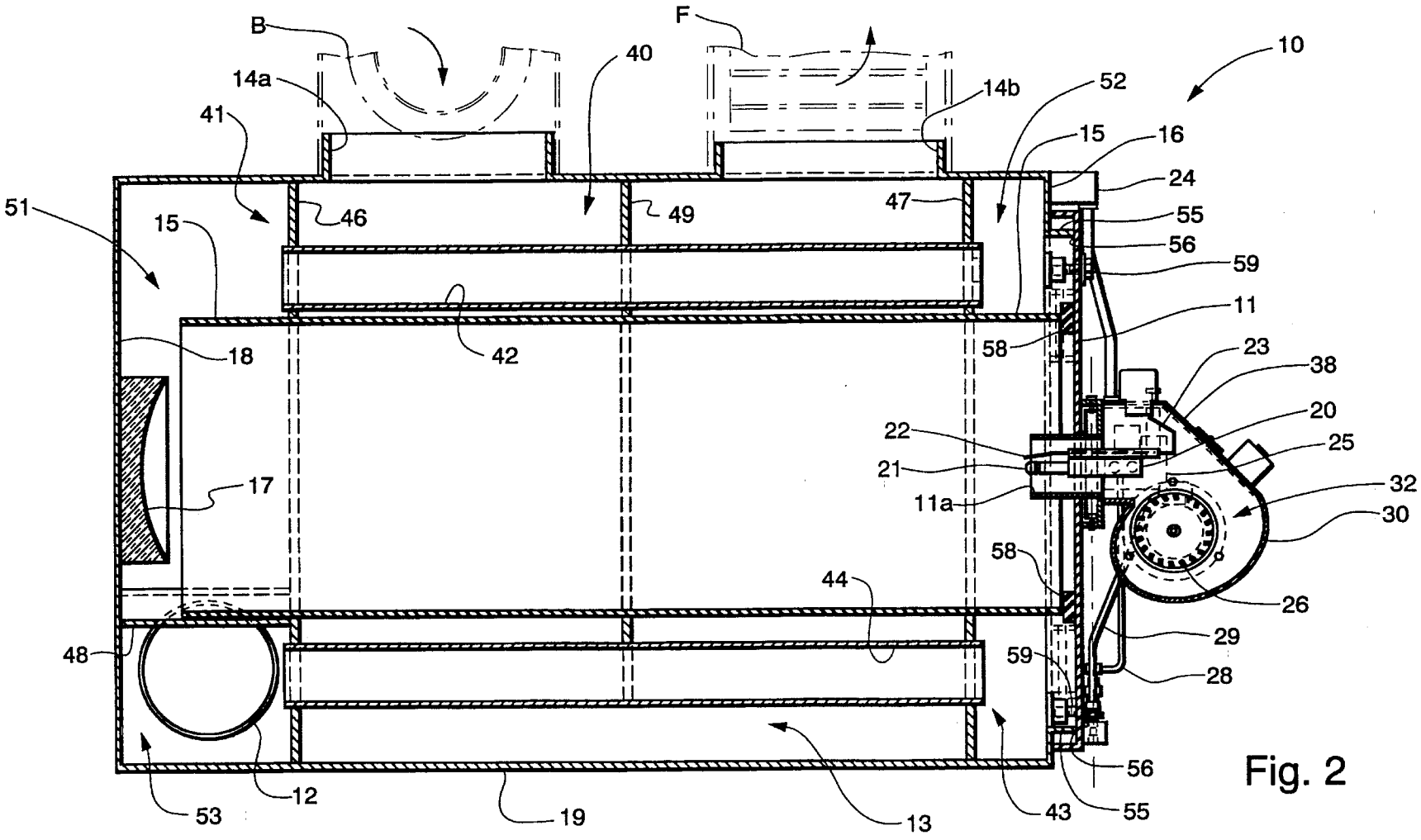
FIG. 2 is a cross-sectional view of the multi oil furnace taken along lines 2—2 in FIG. 1.
Figure 3:
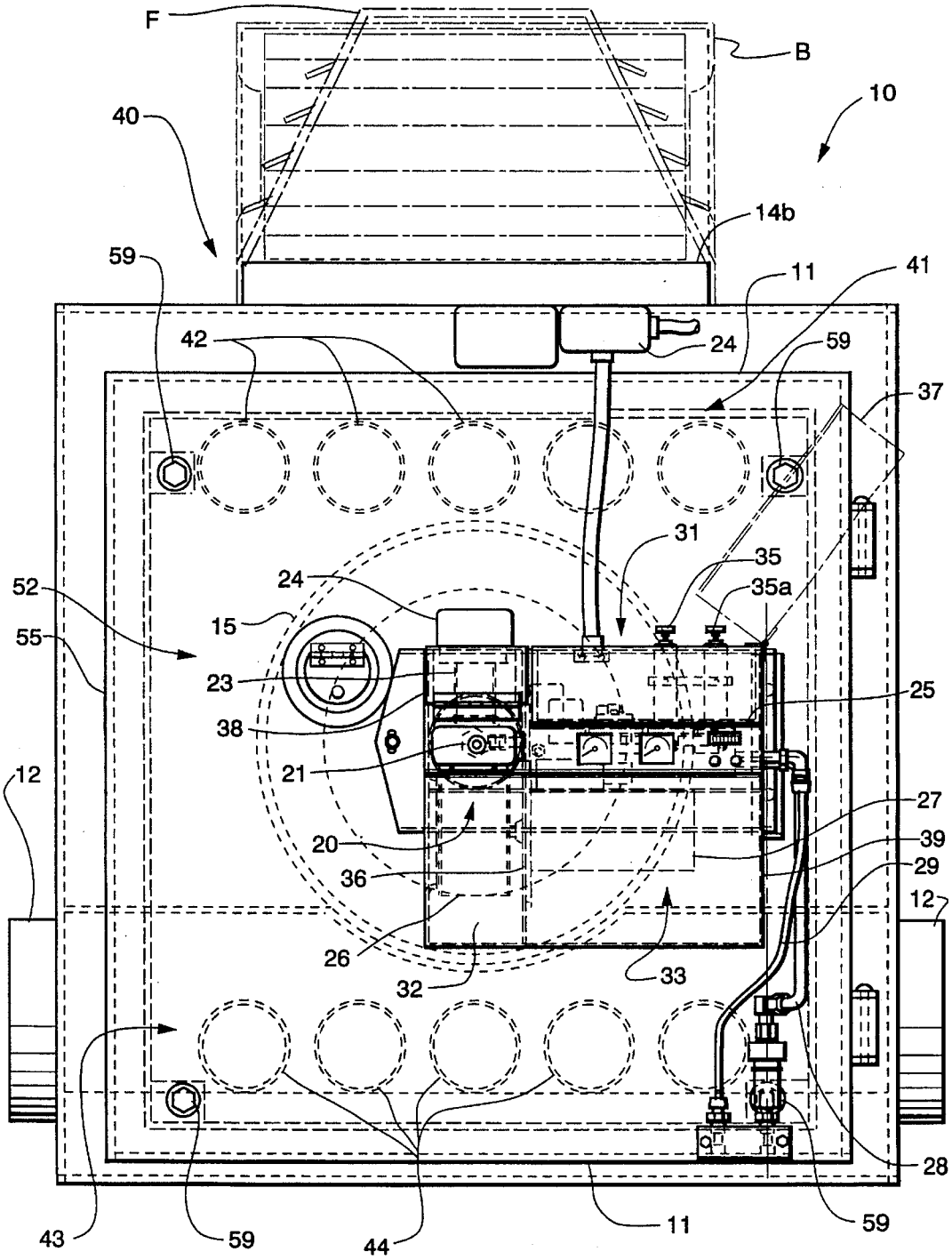
FIG. 3 is a front elevational view of the multi oil furnace shown in FIG. 1.

Referring now to FIGS. 1–3, a top plan, cross-sectional and front elevational views of a multi oil furnace incorporating the principles of the instant invention can best be seen. The furnace 10 includes a cabinet shell 19 enveloping a heat exchanger 40 and a central burner chamber 15. A burner assembly 20 is mounted on the front door 11 to fire a flame through a burner opening 11*a* into the burner chamber 15 toward a ceramic target 17 mounted on the back wall 18 of the cabinet shell 19. The configuration of the heat exchanger 40 will be discussed in greater detail below, but generally allows the circulation of clean air to be heated through a central ventilation chamber 13 to absorb heat from the burner chamber and from the circulating combustion gases before being discharged from the furnace 10. The cabinet shell 19 incorporates a ventilation air inlet opening 14*a* and a ventilation air exit opening 14*b* for access to the ventilation chamber 13 to provide for the passage of the clean ventilation air to be heated through the heat exchanger 40.

Figure 4:
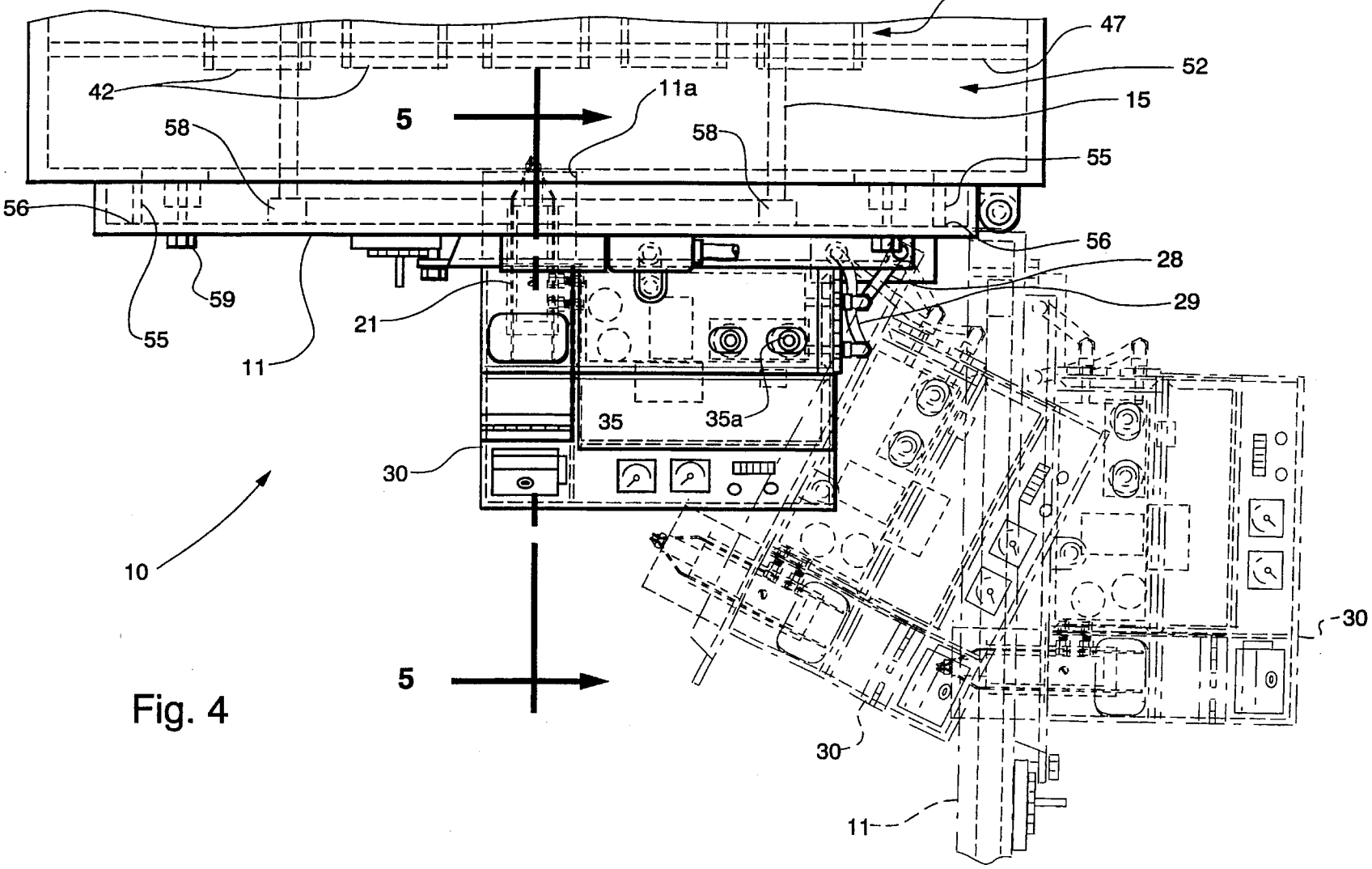
FIG. 4 is an enlarged top plan view of the pivotally mounted front door of the furnace cabinet and the pivotally mounted burner housing, similar to the view of FIG. 1, with the pivotal movements of the burner housing and the front door being shown in phantom.
Figure 5:
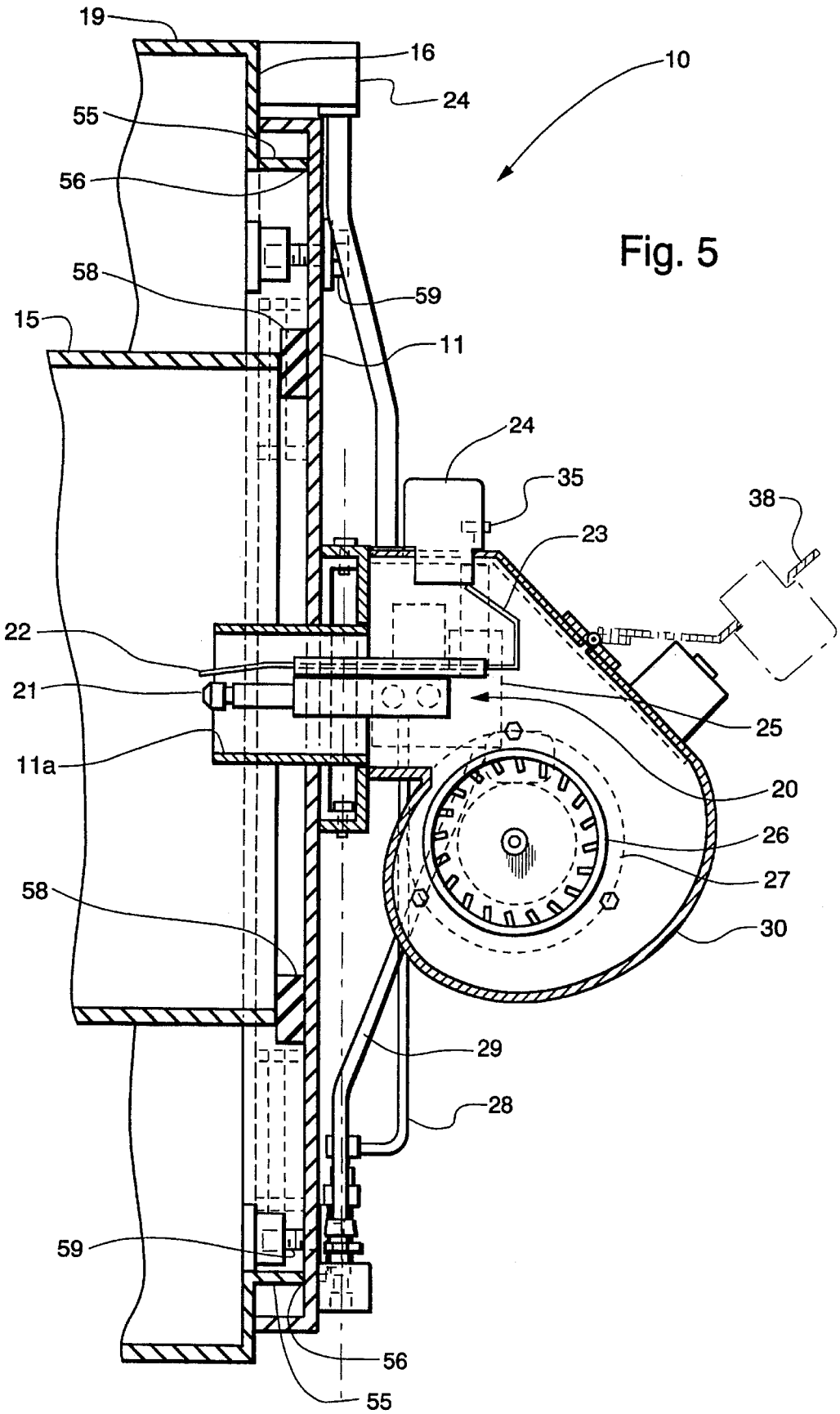
FIG. 5 is an enlarged cross-sectional view of the multi oil furnace taken along lines 5—5 of FIG. 4 to better show the relationship between the components at the front wall of furnace.

Referring now to the views of FIGS. 3, 4 and 5, the details of the burner assembly 20 can best be seen. The configuration and operation of the burner assembly 20 is described in greater detail in applicants' co-pending patent application entitled "Preheater Block for Multi Oil Furnaces", filed concurrently herewith and assigned U.S. Ser. No. 08/227,257 filed Apr. 14, 1994, the descriptive portions of which are incorporated herein by reference. The burner assembly 20 includes a burner nozzle 21 and an igniter 22, which receives power through electrodes 23 connected to a source of electrical current 24, to create a flame from the used oil supplied thereto from a remote source by the used oil connecting line 28. Compressed air supplied from a remote source via the compressed air connecting line 29 is utilized by the burner assembly 20 to atomize the used oil to enhance the efficiency of the combustion process.

The burner assembly 20 includes a preheater block 25 that preheats the supplies of used oil and compressed air to a predetermined temperature, preferably in the range of 130° to 160° F., before being fed to the nozzle 21. A combustion air fan 26 and associated motor 27 provide a flow of combustion air into the burner chamber for proper combustion of the used oil at the burner nozzle 21. The burner assembly 20 is mounted within a burner housing 30, which is pivotally mounted to the front door 11 for service thereof as is described in Applicants' co-pending patent application entitled "Multi Oil Furnace Service Doors", filed concurrently herewith and given U.S. Ser. No. 08/227,258 now U.S. Pat. No. 5,408,941 the descriptive portions of which are incorporated herein by reference.

The burner housing 30 is divided into three compartments 31, 32 and 33, respectively, to improve serviceability of the controls and operative components of the furnace 10. The preheater block 25 and associated operative controls are supported in the first housing compartment 31. The used oil connecting line 28 and the compressed air connecting line 29 pass through corresponding openings in the right side wall 34 to connect with the preheater block 30. Similarly, the interior wall 36 separating the first and second housing compartments 31, 32 is provided with appropriate openings for the passage of the connecting lines supplying preheated used oil and compressed air, respectively, to the burner nozzle 21, which is supported in a cantilever manner from the preheater block 25 in the second housing compartment 32 with the combustion fan 26 blowing combustion air over the burner nozzle 21 into the burner chamber 15. The motor 27 for the combustion fan 26 is found in the third housing compartment 33.

Each of the housing compartments 31, 32 and 33, is provided with its own removable cover 37, 38 and 39, respectively. The first compartment cover 37 is hinged to the right side wall 74 and opens to expose the entire preheater block 25 and attached components for servicing, testing, etc. The first compartment cover 37 has a pair of apertures through the top surface to expose the oil and air regulators 35, 35*a* for manual manipulation without requiring the cover 37 to be opened. The third compartment cover 39 is simply attached to the right side wall 34 to cover an access opening therein to allow access to the fan motor 27. The second compartment cover 38 is hinged to and forms a portion of the curved outer peripheral portion 35 of the second compartment 72. A power transformer 24, which receives electrical power from the primary source of electrical power 24*a*, is mounted on the second compartment cover 38 and operatively extends into the second housing compartment 32 for connection with the electrodes 23 of the igniter 22.

The construction of the furnace 10 can be best seen in FIGS. 1–3. The front wall 16 of the cabinet shell 19 is provided with the front door 11 pivotally mounted thereto for pivotal movement as shown in phantom in FIG. 1. The heat exchanger 40 includes an upper bank 41 of conduits 42 oriented generally parallel to the longitudinal orientation of the burner chamber 15. These conduits 42 pass through the ventilation chamber 13 in a spaced-apart configuration to allow ambient ventilation air to flow therebetween. The heat exchanger 40 further includes a lower bank 43 of conduits 44 oriented generally parallel to the both the burner chamber 15 and the upper bank 41. These conduits 44 also pass through the ventilation chamber 13 in a spaced-apart configuration to allow ambient ventilation air to flow therebetween.

To seal the flow path for the combustion gases from the ventilation chamber 13, the furnace 10 uses header walls 46, 47 and 48, which, in conjunction with the respective walls of the cabinet shell 19 define header areas 51, 52 and 53 in which the combustion gases are required to make abrupt right angle turns within the flow path. The first header wall 46 extends around the burner chamber 15 and around the distal ends of each of the conduits 42 in the upper bank 41. Accordingly, the first header 51 couples the burner chamber 15 with the upper bank 41 and forces the combustion gases to turn ninety degrees from their normal vertically rising path of travel and flow through the conduits 42 toward the front wall 16 of the cabinet shell 19.

The second header wall 47 encircles all of the conduits 42, 44 in both the upper and lower banks 41, 43 and the burner chamber 15 and, as a result, forms a secondary front wall inwardly of the front wall 16 of the cabinet shell 19 to define the second header 52. The combustion gases traveling through the upper bank 41 of conduits 42 toward the front wall enter the second header area 52 and are forced to turn ninety degrees downwardly and then undergo a second ninety degree turn to enter the lower bank 43 of conduits 44 to travel toward the rear wall 18 of the cabinet shell 19.

The third or outlet header 53 couples the lower bank 43 of conduits 44 and the discharge opening 12 to require the combustion gases to again make a ninety degree turn from the path of travel through the lower bank 43 of conduits 44, as the discharge opening 12 is located in the cabinet shell 19 laterally of the burner chamber 15. As a matter of construction, the header wall 46 would be formed identically to the header wall 47 adjacent the front wall 16 and would extend entirely from the top of the cabinet shell 19 to the bottom, as does the front header wall 47. The two rearward header areas 51, 53 would then be separated by the third header wall 48 which would extend generally laterally below the burner chamber 15 from one side of the cabinet shell to the other and longitudinally between the first header wall 46 and the rear wall 18 of the cabinet shell 19. The third header 53 is provided with a pair of laterally opposed discharge openings 12, one of which will be used for the ultimate discharge of combustion gases from the furnace 10, while the other will be sealed with a removable door (not shown) to permit cleanout of the third header area 53.

The front door 11 exposes a substantial portion of the second header area 52 and the burner chamber 15 when the front door 11 is moved to the opened position. A lip 55 protrudes longitudinally around the second header area 52 to define the limits thereof. As is best seen in FIGS. 2 and 3, the lip 55 encompasses both the upper and lower banks 41, 43 of conduits and the centrally located burner chamber 15. A refractory seal 56, defining a sealing surface against the front door 11 engages the lip 55 to retain the combustion gases within the second header area 52 when traversing the turns in flow path between the upper bank 41 of conduits and the lower bank 43.

It will also be noted in FIGS. 2 and 3 that the burner chamber 15 extends completely through the second header area 52 and engages the front door 11 where a refractory seal 58, defining a second sealing surface against the front door 11 engages the circumference of the burner chamber 15 to prevent the re-circulation of combustion gases from the second header area 52 into the burner chamber 15. Accordingly, the flow path for the combustion gases exiting the upper bank 41 of conduits 42 must extend around the burner chamber 15 to reach the lower bank 43 of conduits 44. This circulation flow path of combustion gases provides a 360° path for thermal heat transfer to the ambient ventilation medium within the ventilation chamber 13, as will be described in greater detail below. Furthermore, the abrupt right angle turns required of the cooling combustion gases to exit the furnace assists in the precipitation of ash and debris that might be carried in the flow of the combustion gas. Due to the intense temperature within the burner chamber 15, the refractory seal 58 between the front door 11 and the burner chamber 15 is provided with greater depth than the refractory seal 56 against the lip 55. As a result the two sealing surfaces carried by the front door 11 are offset longitudinally with respect to one another.

The ventilation chamber 13 is defined as that central portion of the furnace 10 between the first header wall 46 and the second header wall 47 through which the conduits 42 and 44 and the burner chamber 15 pass. The ventilation chamber 13 is split in two by a lateral vertical barrier 49 that extends entirely from one side of the cabinet shell 19 to the opposing side and extends downwardly from the top wall of the cabinet shell 19 to encircle and support each of the upper conduits 42 and the lower conduits 44, as well as the burner chamber 15. The barrier 49 stops short of the bottom floor of the cabinet shell 19 in order to allow the internal transfer of air from back half of the ventilation chamber 13 to the front half.

The top wall of the cabinet shell 19 is provided with a rearward inlet opening 14*a* and a forward exit opening 14*b*. Typically, the openings 14*a* and 14*b* are equipped with an optional filter F and blower mechanism B, representatively shown in phantom in FIGS. 2 and 3, to force ambient room ventilation air through the ventilation chamber 15 to absorb heat from the combustion gases flowing through the conduits 42, 44 and the flame burning within the burner chamber 15. This heat exchanger 40 configuration providing a 360° loop for thermal heat transfer is advantageously utilized by the ventilation chamber 13 configuration providing a dual pass for the ventilation air around the conduits 42, 44 and burner chamber 15 before exiting the furnace 10. The net result is an efficient transfer of heat to the ambient room air.

One skilled in the art will readily realize that the ventilation air flow could be piped to a remote location by the appropriate engagement of a conduit with the exit and/or inlet openings. Furthermore, the ventilation chamber 13 could also be sealed off and utilized as a boiler with the heat transferred from the conduits 42, 44 and burner chamber 15 to a ventilation medium other than the ambient room air.

Clean-out of ash and other debris accumulated during the burning of used oil products is easily accomplished with the configuration of the instant furnace 10. Ash will accumulate primarily where cooling combustion gases make abrupt right angle turns within the flow path. Accordingly, the greatest accumulation of ash and debris precipitated from the combustion gas flow will likely be found in the second header area 52, as the cooling combustion gases must make consecutive right angle turns to exit the upper bank 41 of conduits and enter the lower bank 43, as traverse an arcuate path around the burner chamber 15 as well. Another location for significant ash accumulation will be at the bottom of the outlet header 53.

Furnace clean-out is easily accomplished by removing the lock-down bolts 59 fixing the front door 11 to the front wall 16 of the cabinet shell 19, and allowing the front door 11 to be pivotally moved about its hinge to the open position shown in phantom in FIG. 1. This opening of the front door 11 must not be door while the furnace 10 is operating, as the used oil and compressed air lines 28, 29 are preferably disconnected to facilitate the opening of the front door 11. Preferably, the furnace 10 will be allowed to cool before opening the front door 11, which exposes the entire second header area 52. Ash and/or debris will be found at the bottom of the second header 52 accumulated against the lip 55 where the ash can be easily swept away.

While the front door 11 is opened, access to each of the conduits 42, 44 can be had to clean out any residue therein, preferably with a flue brush or the like. Likewise, the burner chamber 15 can also be cleaned of any residue without any further removal of furnace components. Accordingly, one skilled in the art can readily see that service and maintenance of the furnace is greatly improved over that previously known in the art. The outlet header area 53 can also be easily accessed through removal of a plate covering the unused discharge opening 12 laterally opposite the actual discharge opening 12 used to exit combustion gases from the furnace. As best seen in FIG. 3, the outlet header area 53 is provided with laterally opposed openings to allow the installation of a flue conduit to either side, depending on the actual installation of the furnace 10. The unused discharge opening can then be used as the clean-out access opening to clean ash and/or debris from the outlet header 53.

Following the above-described maintenance procedure, the furnace can very quickly be made operational again merely by closing the front door 11, reinstalling the lock-down bolts 49 to snugly fit the seals 56, 58 carried by the front door 11 against the lip 55 of the front header 52 and the burner chamber 15, respectively, having first ascertained that the seals 56, 58 were intact; re-connection of the used oil and compressed air supply lines 28, 29; and a re-attachment of the clean-out door in the outlet header area 53 to maintain the integrity of the air-tight second header 52 and outlet header 53.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description may be employed in other embodiments without departing from the scope of the invention. Accordingly, the following claims are intended to protect the invention broadly as well as in the specific form shown.

Having thus described the invention, what is claimed is:

1. A multi oil furnace comprising:

an external cabinet shell having a door pivotally mounted thereon for covering a front opening for internal access to said cabinet shell, said door being movable between a closed position and an opened position and having a burner opening therethrough;

an elongated burner chamber supported within said cabinet shell in alignment with said burner opening for the burning of a flame therewithin to generate heat, said burner chamber being sealed against said door when in said closed position;

a burner assembly mounted on said front door and being operably coupled to means for providing a flow of air and a flow of used oil, said burner assembly being operable to ignite a combined flow of air and used oil to fire a flame through said burner opening into said burner chamber;

a heat exchanger supported within said cabinet shell to circulate exhaust gases from said burner chamber within said cabinet shell, said heat exchanger including first and second banks of conduits; and a front header adjacent said door and encircling said burner chamber for interconnecting said first and second banks of conduits in flow communication, said burner chamber extending through said front header such that said exhaust gases flowing through said front header from said first bank to said second bank must flow around said burner chamber.

2. The multi oil furnace of claim 1 wherein said front header includes a lip extending around the circumference thereof, said lip being sealable against said door when in said closed position.

3. The multi oil furnace of claim 2 wherein door includes a first sealing surface engageable with said burner chamber and a second sealing surface engageable with said lip.

4. The multi oil furnace of claim 3 wherein said lip is spaced below said second bank of conduits to allow ash to accumulate within said front header.

5. The multi oil furnace of claim 4 wherein said first bank of conduits is positioned above said second bank of conduits, said burner chamber being located between said first and second banks of conduits.

6. The multi oil furnace of claim 5 wherein both said first and second banks of conduits are accessible through said front opening when said door is moved to said opened position.

7. In a multi oil furnace having an external cabinet shell having a front wall and a rear wall, said front wall having a door pivotally mounted thereon for internal access to said cabinet shell, said door being movable between an opened position and a closed position and defining a burner opening therethrough; an elongated burner chamber supported within said cabinet shell in alignment with said burner opening and being oriented longitudinally between said front and rear walls for the burning of a flame therewithin to generate heat; a burner assembly mounted on said front door and being operably coupled to means for providing a flow of air and a flow of used oil, said burner assembly being operable to ignite a combined flow of air and used oil to fire a flame through said burner opening into said burner chamber; a heat exchanger supported within said cabinet shell to circulate exhaust gases from said burner chamber within said cabinet shell, said heat exchanger including first and second banks of conduits; and an exhaust opening formed in said cabinet shell in flow communication with said heat exchanger to allow exhaust gases to exit said cabinet shell, the improvement comprising:

said door being sealed against said burner chamber when in said closed position, said cabinet shell defining a front header adjacent said door and encircling said burner chamber for interconnecting said first and second banks of conduits in flow communication, said burner chamber extending through said front header such that said exhaust gases flowing through said front header from said first bank to said second bank must flow around said burner chamber.

8. The multi oil furnace of claim 7 wherein said front header includes a lip extending around the circumference thereof, said lip being sealable against said door when in said closed position.

9. The multi oil furnace of claim 8 wherein door includes a first sealing surface engageable with said burner chamber and a second sealing surface engageable with said lip.

10. The multi oil furnace of claim 9 wherein said first and second sealing surfaces are offset longitudinally.

11. The multi oil furnace of claim 9 wherein said lip is spaced below said second bank of conduits to allow ash to accumulate within said front header.

12. A multi oil furnace comprising:

an external cabinet shell having a door pivotally mounted thereon and being registerable with a front opening allowing internal access to said cabinet shell, said door being movable between a closed position and an opened position and having a burner opening therethrough, said door including a first sealing surface engageable with said burner chamber and a second sealing surface engageable with said lip;

an elongated burner chamber supported within said cabinet shell in alignment with said burner opening for the burning of a flame therewithin to generate heat, said burner chamber being sealed against said door when in said closed position;

a burner assembly mounted on said front door and being operably coupled to means for providing a flow of air and a flow of used oil, said burner assembly being operable to ignite a combined flow of air and used oil to fire a flame through said burner opening into said burner chamber;

a heat exchanger supported within said cabinet shell to circulate exhaust gases from said burner chamber within said cabinet shell, said heat exchanger including first and second banks of conduits; and a front header adjacent said door and encircling said burner chamber for interconnecting said first and second banks of conduits in flow communication, said burner chamber extending through said front header such that said exhaust gases flowing through said front header from said first bank to said second bank must flow around said burner chamber, said front header including a lip extending around the circumference thereof, said lip being sealable against said door when in said closed position.

13. The multi oil furnace of claim 12 wherein said first bank of conduits is positioned above said second bank of conduits, said burner chamber being located between said first and second banks of conduits, said lip being spaced below said second bank of conduits to allow ash to accumulate within said front header.

14. The multi oil furnace of claim 13 wherein both said first and second banks of conduits are accessible through said front opening when said door is moved to said opened position.

15. A multi oil furnace comprising:

an external cabinet shell having a door pivotally mounted thereon for covering a front opening for internal access to said cabinet shell, said door being movable between a closed position and an opened position and having a burner opening therethrough;

an elongated burner chamber supported within said cabinet shell in alignment with said burner opening for the burning of a flame therewithin to generate heat, said burner chamber being sealed against said door when in said closed position;

a burner assembly mounted on said front door and being operably coupled to means for providing a flow of air and a flow of used oil, said burner assembly being operable to ignite a combined flow of air and used oil to fire a flame through said burner opening into said burner chamber;

a heat exchanger supported within said cabinet shell to circulate exhaust gases from said burner chamber within said cabinet shell, said heat exchanger including first and second banks of conduits; and a front header adjacent said door to interconnect said first and second banks of conduits, said burner chamber extending through said front header such that said exhaust gases flowing through said front header from said first bank to said second bank must flow around said burner chamber;

said front header including a lip extending around the circumference thereof, said lip being sealable against said door when in said closed position, said door including a first sealing surface engageable with said burner chamber and a second sealing surface engageable with said lip, said first and second sealing surfaces being offset longitudinally.

16. The multi oil furnace of claim 15 wherein said lip is spaced below said second bank of conduits to allow ash to accumulate within said front header.

17. The multi oil furnace of claim 16 wherein both said first and second banks of conduits are accessible through said front opening when said door is moved to said opened position.

18. In a multi oil furnace having an external cabinet shell having a front wall and a rear wall, said front wall having a door pivotally mounted thereon for internal access to said cabinet shell, said door being movable between an opened position and a closed position and defining a burner opening therethrough; an elongated burner chamber supported within said cabinet shell in alignment with said burner opening and being oriented longitudinally between said front and rear walls for the burning of a flame therewithin to generate heat; a burner assembly mounted on said front door and being operably coupled to means for providing a flow of air and a flow of used oil, said burner assembly being operable to ignite a combined flow of air and used oil to fire a flame through said burner opening into said burner chamber; a heat exchanger supported within said cabinet shell to circulate exhaust gases from said burner chamber within said cabinet shell, said heat exchanger including first and second banks of conduits; and an exhaust opening formed in said cabinet shell in flow communication with said heat exchanger to allow exhaust gases to exit said cabinet shell, the improvement comprising:

said door being sealed against said burner chamber when in said closed position, said cabinet shell defining a front header adjacent said door to interconnect said first and second banks of conduits, said burner chamber extending through said front header such that said exhaust gases flowing through said front header from said first bank to said second bank must flow around said burner chamber; and said front header including a lip extending around the circumference thereof, said lip being sealable against said door when in said closed position and being spaced below said second bank of conduits to allow ash to accumulate within said front header.

19. A multi oil furnace comprising:

an external cabinet shell having a door pivotally mounted thereon and being registerable with a front opening allowing internal access to said cabinet shell, said door being movable between a closed position and an opened position and having a burner opening therethrough, said door including a first sealing surface engageable with said burner chamber and a second sealing surface engageable with said lip;

an elongated burner chamber supported within said cabinet shell in alignment with said burner opening for the burning of a flame therewithin to generate heat, said burner chamber being sealed against said door when in said closed position;

a burner assembly mounted on said front door and being operably coupled to means for providing a flow of air and a flow of used oil, said burner assembly being operable to ignite a combined flow of air and used oil to fire a flame through said burner opening into said burner chamber;

a heat exchanger supported within said cabinet shell to circulate exhaust gases from said burner chamber within said cabinet shell, said heat exchanger including first and second banks of conduits; and a front header adjacent said door to interconnect said first and second banks of conduits, said burner chamber extending through said front header such that said exhaust gases flowing through said front header from said first bank to said second bank must flow around said burner chamber, said front header including a lip extending around the circumference thereof, said lip being sealable against said door when in said closed position, said first and second banks of conduits being accessible through said front opening when said door is moved to said opened position.

20. The multi oil furnace of claim 19 wherein said door includes a first sealing surface engageable with said burner chamber and a second sealing surface engageable with said lip, said lip being spaced below said second bank of conduits to allow ash to accumulate within said front header.

21. The multi oil furnace of claim 20 wherein said first and second sealing surfaces are offset longitudinally.

* * * * *